US006112954A

United States Patent [19]

Schwerdtfeger et al.

[11] Patent Number: 6,112,954

[45] Date of Patent: Sep. 5, 2000

[54] CASTING NOZZLE FOR THIN STRIP CASTING PLANTS

[75] Inventors: Klaus Schwerdtfeger, Goslar; Karl-Heinz Spitzer, Clausthal-Zellerfeld; Wolfgang Reichelt; Ulrich Urlau, both of Moers; Joachim Kroos, Meine; Michael Brühl, Wolfenbüttel, all of Germany

[73] Assignee: Mannesmann AG, Düsseldorf, Germany

[21] Appl. No.: 09/194,849

[22] PCT Filed: Jun. 3, 1997

[86] PCT No.: PCT/DE97/01151

§ 371 Date: Dec. 4, 1998

§ 102(e) Date: Dec. 4, 1998

[87] PCT Pub. No.: WO97/47412

PCT Pub. Date: Dec. 18, 1997

[30] Foreign Application Priority Data

Jun. 7, 1996 [DE] Germany ..... 196 22 924

Sep. 10, 1996 [DE] Germany ..... 196 36 697

[51] Int. Cl.[7] ..... B22D 35/06

[52] U.S. Cl. ..... 222/593; 222/592; 164/471

[58] Field of Search ..... 222/591, 592, 222/593; 164/471, 428, 432

[56] References Cited

U.S. PATENT DOCUMENTS

| | | | |
|---|---|---|---|
| 2,838,814 | 6/1958 | Brennan | 164/471 |
| 5,439,047 | 8/1995 | Eckert | 164/471 |
| 5,799,720 | 9/1998 | Ross et al. | 222/593 |

*Primary Examiner*—Scott Kastler
*Attorney, Agent, or Firm*—Cohen, Pontani, Lieberman & Pavane

[57] ABSTRACT

A nozzle for thin strip casting plants, especially for steel strip. In casting plants of this type, the liquid steel must be applied on a carrier from the nozzle forming a casting gap. At least one primary coil and a secondary coil are arranged at the nozzle, wherein the secondary coil is water-cooled and projects into the area of the casting gap.

4 Claims, 1 Drawing Sheet

CASTING NOZZLE FOR THIN STRIP CASTING PLANTS

BACKGROUND OF THE INVENTION

1. Field of the Invention

The invention is directed to a casting nozzle for thin strip casting plants, especially for casting thin steel strip.

2. Discussion of the Prior Art

DE 37 07 897 discloses a nozzle for casting thin steel strip in which the nozzle forms a back dam which adjoins a movable carrier and a front dam. A casting gap is defined toward the carrier between the back dam and front dam.

Nozzles of the type mentioned above are usually made from refractory material which is subjected to a certain degree of wear at high temperatures of the steel melt, so that the shape of the casting gap can change during casting; however, the nozzle must be exchanged in any case after a certain period of use.

SUMMARY OF THE INVENTION

It is an object of the invention to provide an improved nozzle construction in which wear is minimized and in which the melt can be heated in the region of the casting gap.

Pursuant to this object, and others which will become apparent hereafter, one of the present invention resides at least one primary inductor and at least one secondary inductor at the nozzle. At least one secondary inductor is water-cooled and projects into the region of the casting gap.

Through the use of a primary inductor and a secondary inductor as separate component parts for generating an electromagnetic field which extends into the region of the melt, the melt is prevented, on the one hand, from reaching the wall of the primary inductor which would lead to electrical short circuiting. On the other hand, an eddy current field can be induced in the melt itself by means of the currents induced in the secondary inductor, so that it is made possible to heat the melt in the region of the outlet or pouring opening. In this way, the pouring opening can be protected from changes caused by deposits of solidified melt. Further, the electromagnetic forces in the melt lead to a displacement of the melt from the secondary inductor which also helps to prevent deposits. The above-described principle is used in the known cold crucible technique to melt metals in water-cooled crucibles.

According to a further embodiment of the invention, a secondary inductor is formed of a plurality of portions which are electrically insulated from one another. Accordingly, every portion acts as an independent secondary inductor.

According to another embodiment, a plurality of outlet openings for the melt which are arranged adjacent to one another in the width direction of the thin strip are formed between the back dam and front dam.

This results in a more uniform distribution of the melt over the width of the casting gap (thin strip width). The formation of outlet openings is achieved by a corresponding shaping of the back dam in the conveying direction or by a corresponding shaping of the front dam in the direction opposite to the conveying direction.

According to a further embodiment, a secondary inductor is constructed in the back dam from a plurality of insulated portions, each of which has an inlet and outlet for cooling water. The individual portions are constructed in a dovetail-shaped or arrow-shaped or straight manner for forming the outlet openings for the melt. In particular, a flow directing plate is provided in the interior of the portions, so that a positive guidance is achieved between the inlet and outlet at the end of the portions directed opposite to the casting gap up to the head area of the portions which faces the casting gap.

According to another preferred embodiment, electrically insulated portions of a secondary inductor with an inlet and outlet for cooling water are arranged in the region of the front dam, wherein the portions are dovetail-shaped or arrow-shaped or straight in the head region of the portions, namely, where the front dam adjoins the casting gap to form outlet openings.

It is understood that reference to the dovetail shape or arrow shape of the front dam or back dam in the area of the outlet openings also comprehends every other possible shape, especially also semi-circular shapes, etc. Also included is a corresponding shaping of the front dam or back dam, e.g., circular outlet openings can also be formed. The portions in the front dam which are insulated with respect to one another preferably also have, in their interior, flow directing plates between the inlet and outlet.

DETAILED DESCRIPTION OF THE PREFERRED EMBODIMENTS

Figure 1:
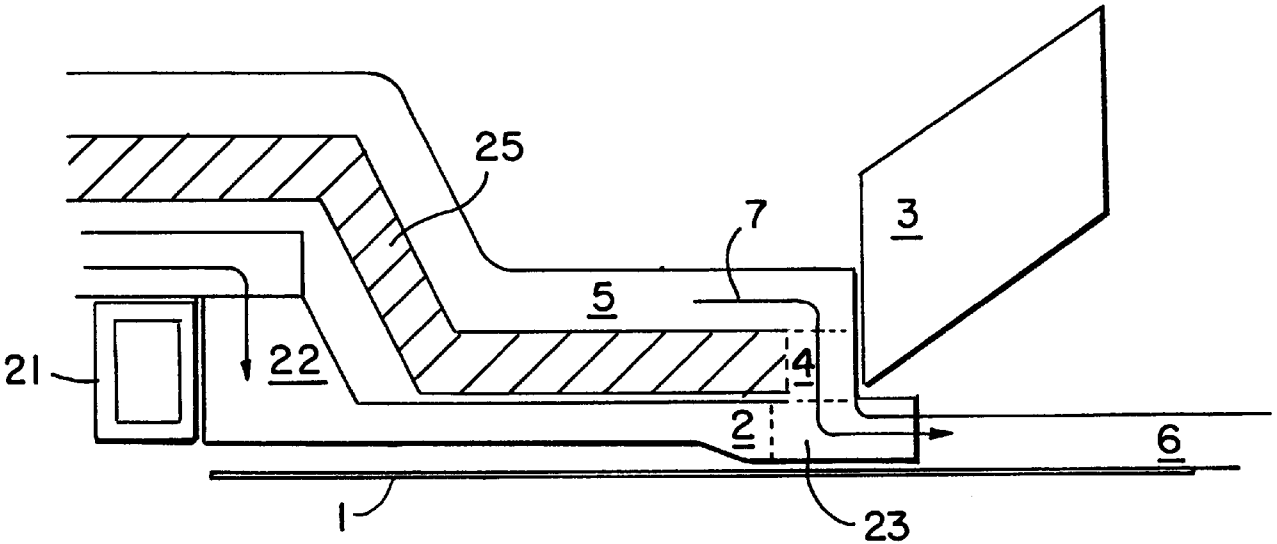
FIG. 1 is a schematic vertical section through a nozzle pursuant to the present invention.

FIG. 1 shows a vertical section through a nozzle, wherein, in the region of the back dam 2, the secondary inductor 22 is formed of individual portions with dovetail-shaped ends. The section lies through the center of the dovetail 23. The back dam 2 is fitted to a carrier 1, especially an endless strip revolving around rollers.

The casting gap 4 is formed between the back dam 2 and the front dam 3. A primary inductor 21 adjoins the secondary inductor 22. In the free area between the dovetail 23 and front dam 3, the liquid steel can flow out of the backup area 5 into the solidification area 6 in the flow direction indicated by arrow 7. A flow directing plate 24 is arranged a portion of the secondary inductor 22. The secondary inductor 22 is covered by refractory material 25 toward the backup area 5. The inductors 22, 23 are water-cooled and are preferably made of copper. The primary inductor 21 is supplied with high frequency.

Figure 2:
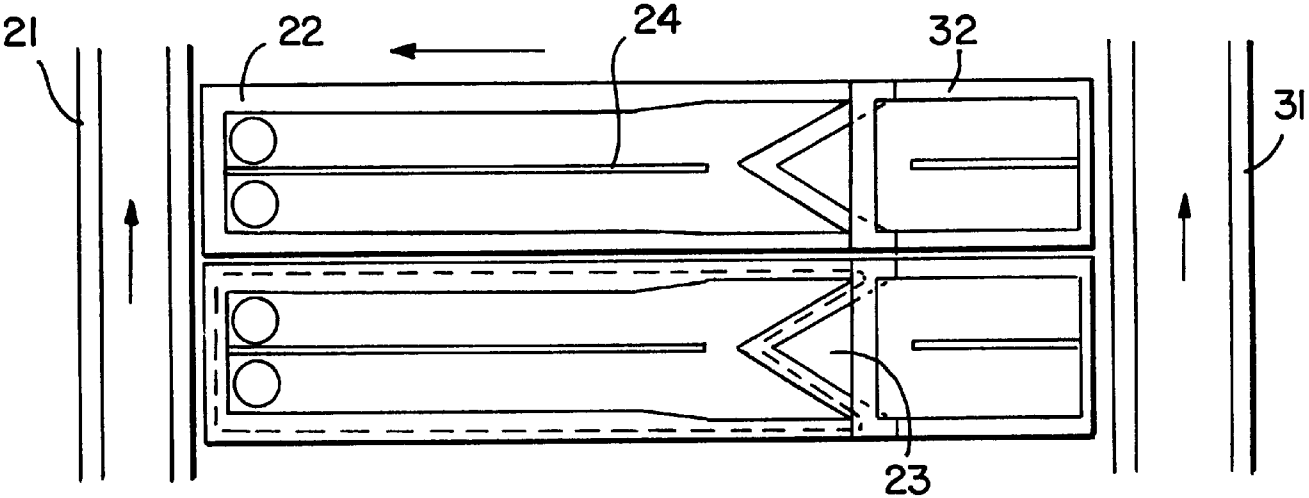
FIG. 2 is a top view of another embodiment of the inventive nozzle.

In the version shown in FIG. 2, the front dam 3 is formed by a plurality of secondary inductors 32 which are electrically insulated from one another and in which a primary inductor 31 induces an electrical current. The primary inductor 31 and secondary inductor 32 are cooled by water and the primary inductor 31 is supplied with high frequency. The secondary inductor 32 extends to the tip of the dovetail of the secondary inductor 22.

What is claimed is:

1. A nozzle for a thin strip casting plant, comprising:

a carrier for thin strip, the carrier being movable in a conveying direction;

a back dam which rests on the carrier;

a front dam arranged to define a casting gap toward the carrier in the conveying direction;

a first primary inductor and a first secondary inductor arranged on the back dam; and a second primary inductor and a second secondary inductor arranged on the front dam, the secondary inductors being water cooled and arranged to project into a region of the casting gap.

2. A nozzle according to claim 1, wherein the secondary inductors are formed of a plurality of portions which are electrically insulated from one another.

3. A nozzle according to claim 1, wherein the back dam and the front dam are configured and arranged to form between them a plurality of outlet openings that are adjacent to one another in a width direction of the thin strip.

4. A nozzle according to claim 3, wherein the secondary inductors are formed of electrically insulated portions with inlets and outlets for cooling water, the portions being one of dovetail-shaped, arrow-shaped and straight so as to form the outlet openings.

* * * * *